US010168037B1

(12) United States Patent
Neuman et al.

(10) Patent No.: US 10,168,037 B1
(45) Date of Patent: Jan. 1, 2019

(54) SSL LIGHTING APPARATUS

(71) Applicant: AUTOMATED ASSEMBLY CORPORATION, Lakeville, MN (US)

(72) Inventors: David Neuman, Randolph, MN (US); Scott Lindblad, Chaska, MN (US); Pat Connolly, Burnsville, MN (US)

(73) Assignee: Automated Assembly Corporation, Lakeville, MN (US)

( * ) Notice: Subject to any disclaimer, the term of this patent is extended or adjusted under 35 U.S.C. 154(b) by 288 days.

(21) Appl. No.: 15/171,328

(22) Filed: Jun. 2, 2016

(51) Int. Cl.
*F21K 9/90* (2016.01)
*F21V 23/00* (2015.01)
*F21Y 101/02* (2006.01)

(52) U.S. Cl.
CPC ..... *F21V 23/001* (2013.01); *F21K 9/90* (2013.01); *F21Y 2101/02* (2013.01); *F21Y 2101/025* (2013.01)

(58) Field of Classification Search
CPC ..... F21V 23/001; F21V 23/00; F21K 9/90; F21Y 2101/02; F21Y 2101/025; F21Y 2105/10; F21Y 2015/12; F21Y 2015/14; F21Y 2015/16; F21Y 2015/18; F21Y 2107/00; F21Y 2107/20; F21Y 2107/30; F21Y 2107/40; F21Y 2107/70; F21S 4/15; H01L 23/00
See application file for complete search history.

(56) References Cited

U.S. PATENT DOCUMENTS

| | | | | |
|---|---|---|---|---|
| 6,657,381 | B1 * | 12/2003 | Arutaki | G09F 9/33 313/512 |
| 7,705,365 | B2 | 4/2010 | Kurokawa et al. | |
| 7,990,512 | B2 | 8/2011 | Yang | |
| 9,128,222 | B1 | 9/2015 | Lindblad et al. | |
| 9,431,363 | B1 | 8/2016 | Lindblad et al. | |
| 2008/0074871 | A1 | 3/2008 | Mies et al. | |
| 2012/0238045 | A1 * | 9/2012 | Roberts | F21K 9/90 438/28 |
| 2013/0051067 | A1 | 2/2013 | Chen | |
| 2013/0099275 | A1 | 4/2013 | Pi et al. | |
| 2014/0111982 | A1 | 4/2014 | Kuenzler | |

OTHER PUBLICATIONS

Neuman et al., U.S. Appl. No. 14/928,289, "Wire Bonded Electronic Devices to Round Wire," filed Oct. 30, 2015.

* cited by examiner

*Primary Examiner* — Bao Q Truong
(74) *Attorney, Agent, or Firm* — Crawford Maunu PLLC

(57) ABSTRACT

A disclosed lighting apparatus includes a first dielectric sheet disposed on the first electrically conductive sheet and a second electrically conductive sheet disposed on the first dielectric sheet. A plurality of solid-state lighting (SSL) elements are electrically coupled to the first electrically conductive sheet and to the second electrically conductive sheet. The first electrically conductive sheet, first dielectric sheet, and second electrically conductive sheet have bends that configure the first electrically conductive sheet, first dielectric sheet, and second electrically conductive sheet in a three-dimensional shape.

20 Claims, 9 Drawing Sheets

SSL LIGHTING APPARATUS

FIELD OF THE INVENTION

The disclosed embodiments generally relate to a solid-state lighting apparatus.

BACKGROUND

Solid-state lighting (SSL) apparatuses have semiconductor structures that emit light. Examples of SSL lighting elements include light-emitting diodes (LEDs), semiconductor laser diodes (LDs), organic light-emitting diodes (OLED), polymer light-emitting diodes (PLED), or quantum dots. SSL is becoming more popular due in part to the energy efficient qualities and durability of SSL. Applications for SSL may include advertising signage, decorations, or utility and general purpose lighting.

For some applications, SSL elements are mounted on a flexible substrate such as those made from polyamides, polyimides, or polyester. Prior to mounting the electronic device, wiring patterns may be formed on the substrate using a print-and-etch process. The wiring patterns are laid out to accommodate placement of one or more devices on the substrate at desired locations.

Making SSL arrangements using a polyamide, polyimide, or polyester substrate may be prohibitively expensive for some applications. The expense is attributable in part to the print-and-etch processes used in creating the wiring pattern. Expensive chemicals are required for print-and-etch processes, and hazardous waste is a byproduct.

SUMMARY

One lighting apparatus includes a first electrically conductive net of a polyhedron, a first dielectric net of the polyhedron, and a second electrically conductive net of the polyhedron. The first dielectric net is disposed on the first electrically conductive net, and the second electrically conductive net is disposed on the first dielectric net. A plurality of solid-state lighting (SSL) elements are electrically coupled to the first electrically conductive net and to the second electrically conductive net. The first electrically conductive net, first dielectric net, and second electrically conductive net have bends that configure the first electrically conductive net, first dielectric net, and second electrically conductive net in a shape of the polyhedron.

Another lighting apparatus includes a first dielectric sheet disposed on the first electrically conductive sheet and a second electrically conductive sheet disposed on the first dielectric sheet. A plurality of solid-state lighting (SSL) elements are electrically coupled to the first electrically conductive sheet and to the second electrically conductive sheet. The first electrically conductive sheet, first dielectric sheet, and second electrically conductive sheet have bends that configure the first electrically conductive sheet, first dielectric sheet, and second electrically conductive sheet in a three-dimensional shape.

A method of making a lighting apparatus includes forming a first plurality of openings in a first electrically conductive sheet and a second plurality of openings in a dielectric sheet. The first electrically conductive sheet is attached to the dielectric sheet such that the first plurality of openings are aligned with the second plurality of openings. A second electrically conductive sheet is attached to the dielectric sheet to form a stack that has a first major surface and an opposing second major surface, which are both planar. A plurality of solid-state lighting (SSL) elements are electrically connected to the first electrically conductive sheet and to the second electrically conductive sheet through the first and second pluralities of openings, respectively. The method includes bending the stack of the first electrically conductive sheet, the dielectric sheet, and the second electrically conductive sheet such that the first major surface and second major surface acquire a three-dimensional shape.

The above summary is not intended to describe each disclosed embodiment. The figures and detailed description that follow provide additional example embodiments and aspects.

BRIEF DESCRIPTION OF THE DRAWINGS

Other aspects and advantages will become apparent upon review of the Detailed Description and upon reference to the drawings in which.

DETAILED DESCRIPTION

Figure 1:
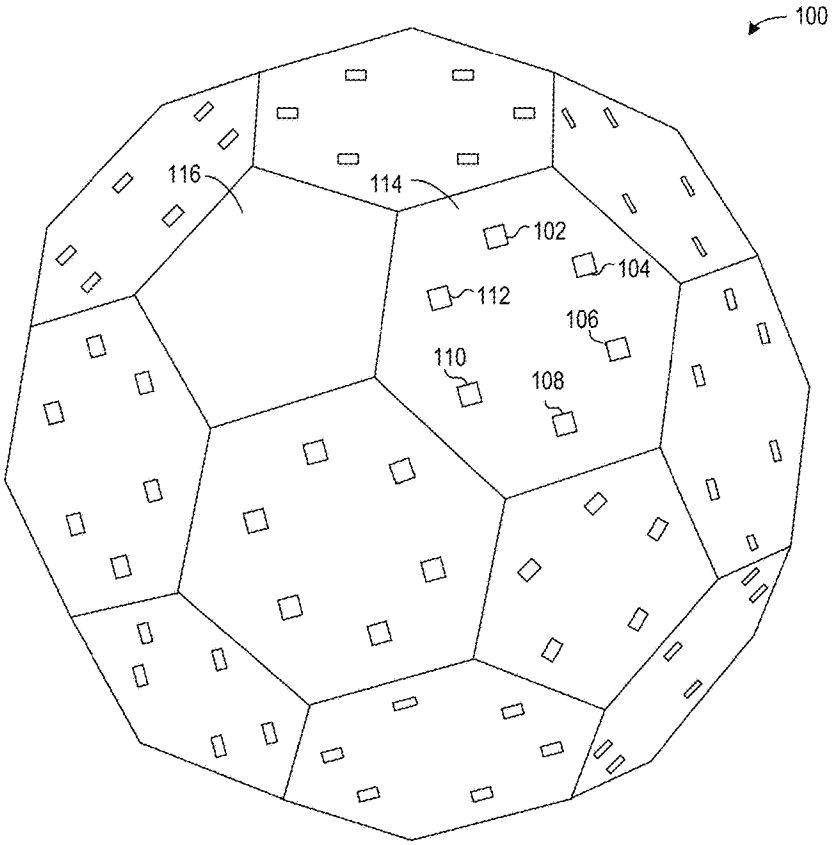
FIG. 1 shows a perspective view of an example of an SSL lighting apparatus in which a stack of nets of a polyhedron have SSL elements connected thereto, and faces of the polyhedron are covered by the stack of nets.

In the following description, numerous specific details are set forth to describe specific examples presented herein. It should be apparent, however, to one skilled in the art, that one or more other examples and/or variations of these examples may be practiced without all the specific details given below. In other instances, well known features have not been described in detail so as not to obscure the description of the examples herein. For ease of illustration, the same reference numerals may be used in different diagrams to refer to the same elements or additional instances of the same element.

This disclosure describes an SSL apparatus that provides even distribution of current to the SSL elements and efficient dissipation of heat from the SSL elements. The SSL apparatus is adaptable for various applications, including general or decorative lighting, for example. The disclosed structures promote economical and environmentally-safe manufacturing methods. In addition, the disclosed teachings may be adapted to make a nearly endless variety of three-dimensional lighting apparatuses.

The disclosure describes an example of a polyhedral lighting apparatus for ease of explanation. It will be appreciated, however, that the aspects of the disclosed lighting apparatus can be applied to lighting apparatuses that are not polyhedral. Specifically, the teachings may be applied to make any lighting apparatus having a three-dimensional shape that can be formed from a stack that includes electrically conductive sheets separated by a dielectric sheet. Examples of non-polyhedrons include cylinders, cones, truncated cones, twisted prisms, etc.

The exemplary lighting apparatuses and methods employ two-dimensional sheets of electrically conductive material to provide power to the SSL elements in the lighting apparatus. The SSL elements are mounted on two-dimensional sheets of electrically conductive material, and the sheets of electrically conductive material are shaped to accommodate folding to form a desired shape, such as a polyhedron.

A polyhedron is generally understood to be a three-dimensional solid having planar polygonal faces. Though the strict definition of a polyhedron requires a solid, polyhedron as used herein may be a hollow structure. In additional, the polyhedrons described herein may have, instead of a solid face, one or more openings to aid in cooling the lighting apparatus.

A "net" of a polyhedron is an arrangement of edge-joined polygons that can be folded along the joined edges to become the faces of the polyhedron. Thus, the surface of a polyhedron can be covered by the two-dimensional, edge-joined polygons of the net. As used herein, a net is not limited to having polygons sufficient to cover all faces of a polyhedron, nor is a net limited to polyhedrons. Rather, a net can include a number of edge-joined polygons such that when the net is folded along the joined edges of the polygons the resulting structure covers a subset of the faces of a polyhedron. In some implementations, each of one or more of the polygons of a net may be slightly smaller than the corresponding face of the polyhedron to allow for mounting on a support frame. A net can also include one or more two-dimensional shapes that can be bent and/or folded to form three-dimensional structures. For example, a rectangular sheet can be bent to form the curved surface of a cylinder. Depending on the desired shape of the lighting apparatus, a net is not limited to one or more polygons. That is, one or more edges of the net may be curved. A net may include one or more irregular shapes or a combination of one or more irregular shapes and one or more polygons. A net need not be a continuous surface. For example, a net may have openings that allow convection currents to cool the lighting apparatus.

FIG. 1 shows a perspective view of an example of an SSL lighting apparatus 100 in which a stack of nets of a polyhedron have SSL elements connected thereto, and faces of the polyhedron are covered by the stack of nets. The exemplary lighting apparatus is a truncated icosahedron and has multiple SSL elements on each polygonal face. Blocks 102, 104, 106, 108, 110, and 112 represent the SSL elements on face 114. Similar blocks on other faces also represent SSL elements. The SSL elements may be attached to the net in any pattern that satisfies application requirements. Different faces may have the SSL elements at different locations, and/or different faces may have different numbers of SSL elements.

Multiple layers of nets form a stack, and the stack is bent to form the exemplary lighting apparatus. An outer-layer net, which is visible in FIG. 1, is an electrically conductive sheet such as aluminum or copper, and one terminal (anode or cathode) of each of the SSL elements is connected to the outer-layer net. Beneath the outer-layer net is a dielectric net (FIG. 3), and beneath the dielectric net is an inner-layer net (FIG. 4), which is an electrically conductive sheet such as copper or aluminum. The other power terminal of each SSL element is connected to the inner-layer net. Together, the outer-layer net, the dielectric net, and the inner-layer net form a shell. In one implementation the shell is supported by an inner frame (FIG. 5), which in the lighting apparatus of FIG. 1 is a polyhedral frame.

In the exemplary lighting apparatus, the polyhedron has two faces that are not covered by the stack of nets. Face 116 is one of the uncovered faces and is visible in the perspective view of FIG. 1. The other uncovered face is not visible in FIG. 1.

The lighting apparatus 100 may also include a globe (not shown) that surrounds the stack of nets and SSL elements. The globe may include phosphorous or organic ink to convert the light from the SSL elements to a desired color.

Figure 2:
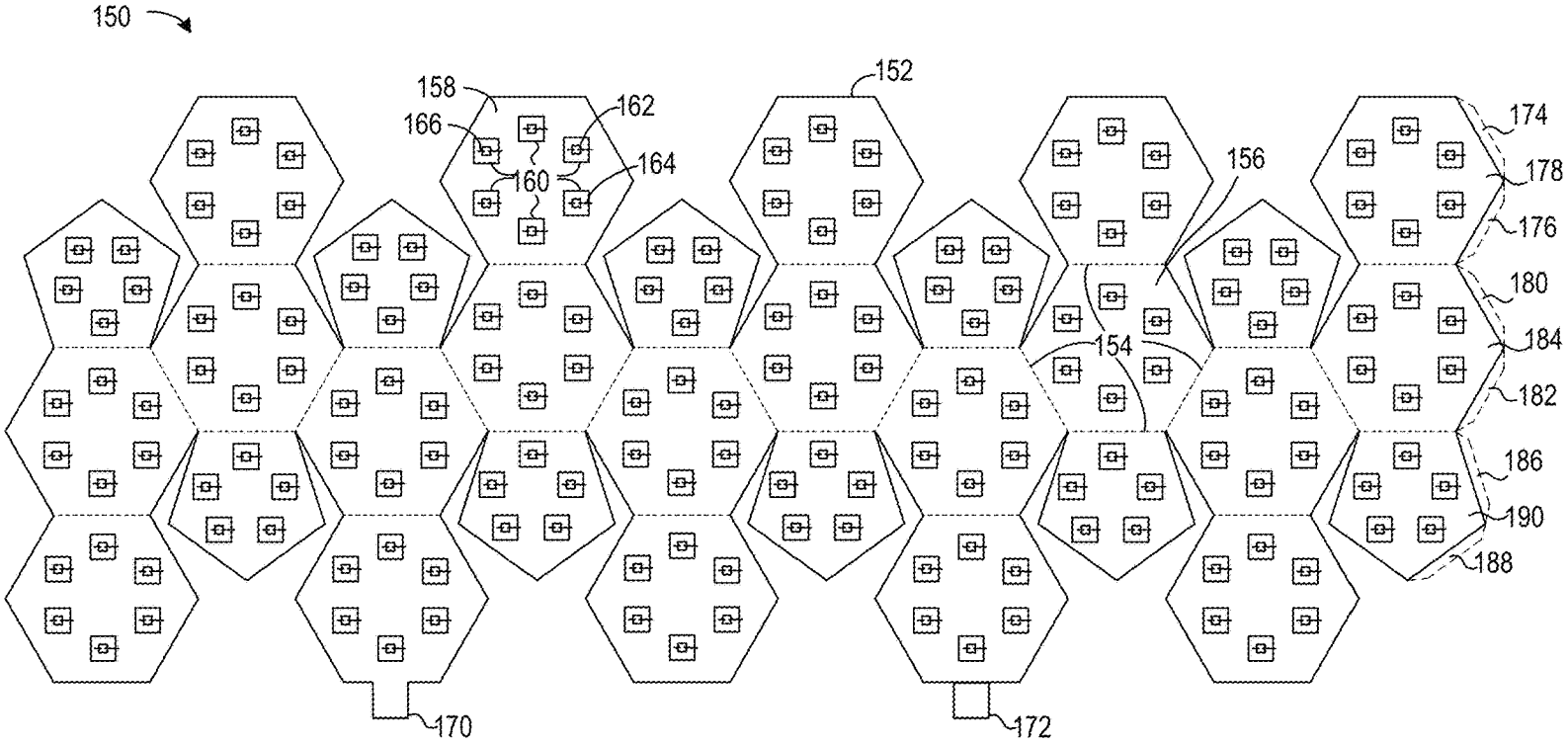
FIG. 2 shows a top view of a stack of nets for the lighting apparatus of FIG. 1.
Figure 3:
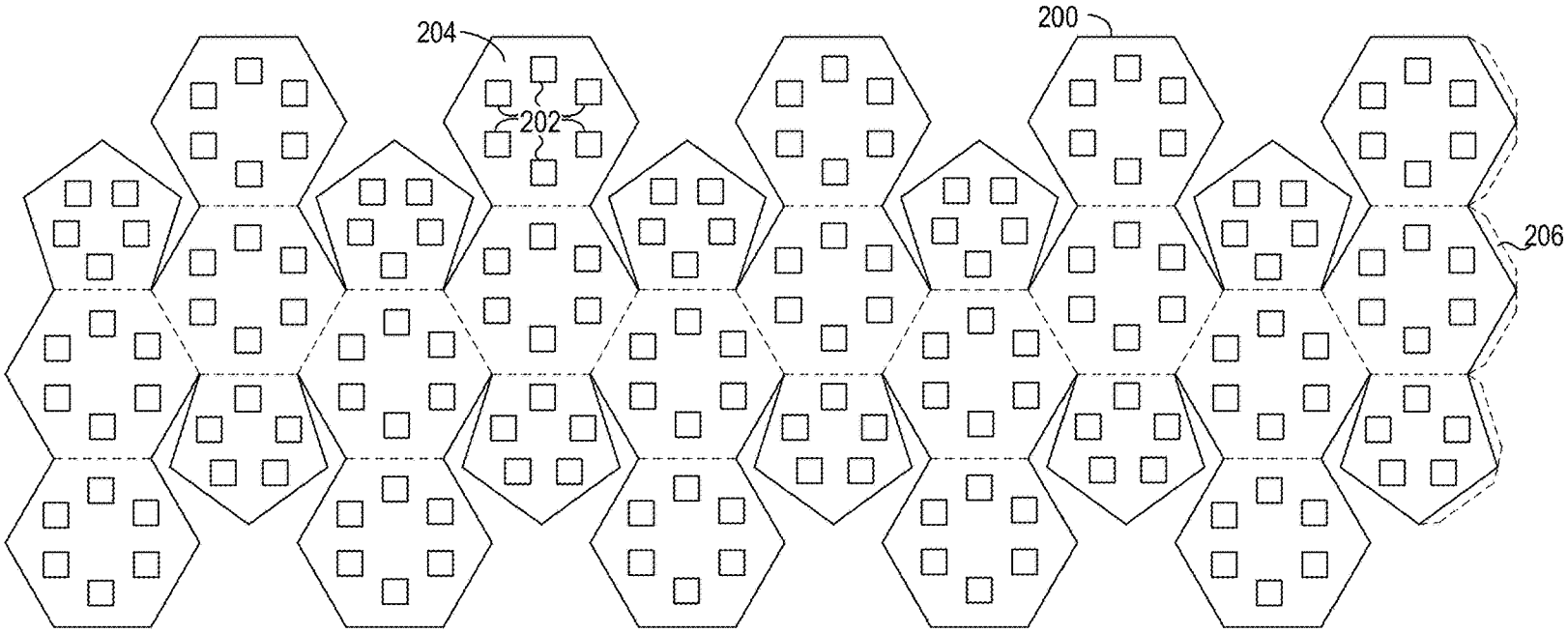
FIG. 3 shows a top view of a dielectric net of the stack of nets shown in FIG. 2 for the lighting apparatus of FIG. 1.
Figure 4:
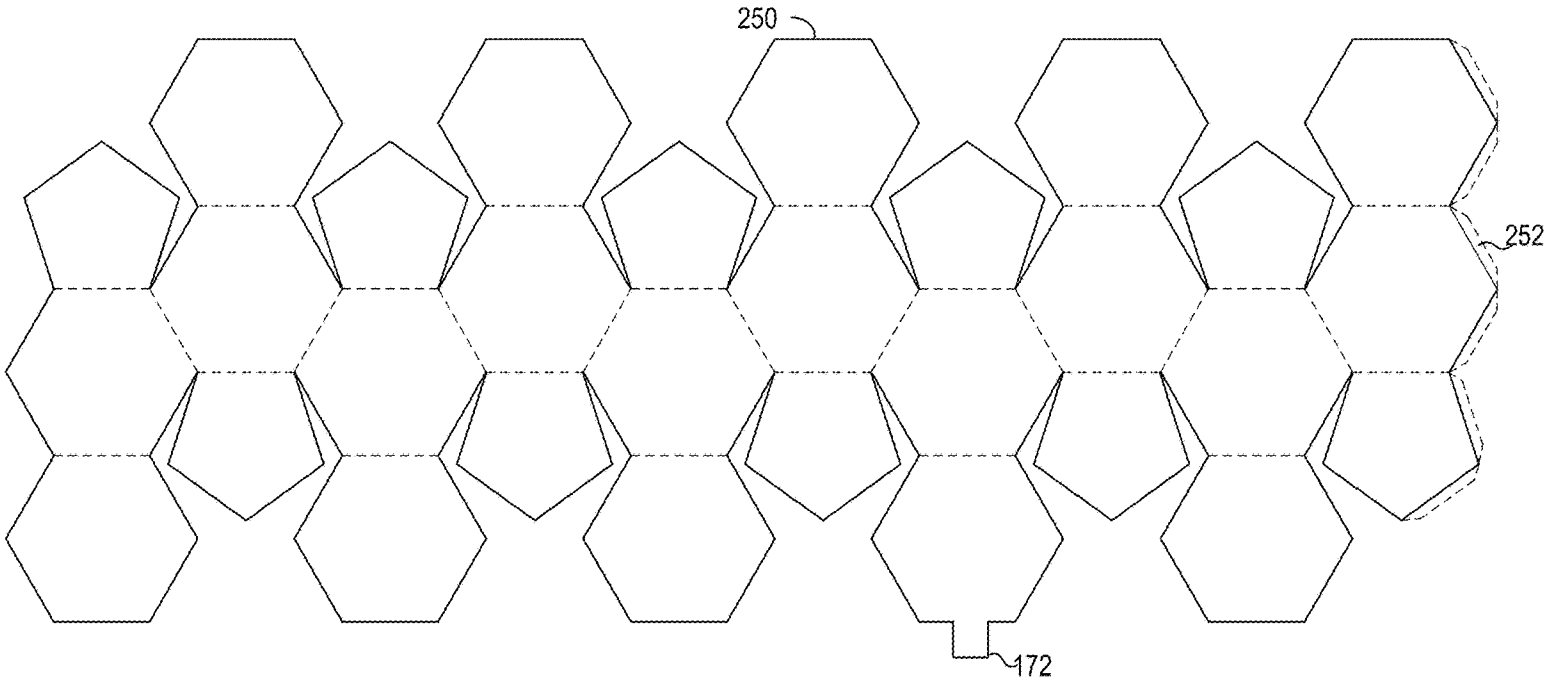
FIG. 4 shows a top view of the inner-layer net of the stack of nets shown in FIG. 2 for the lighting apparatus of FIG. 1.

FIG. 2 shows a top view of a stack of nets 150 for the lighting apparatus of FIG. 1, FIG. 3 shows the dielectric net of the stack, and FIG. 4 shows the inner-layer net of the stack. The dielectric net and the inner-layer net are largely obscured by the outer layer net 152 in FIG. 2. The stack of nets 150 can be folded along edges between the polygons to form the truncated icosahedron lighting apparatus of FIG. 1. The dashed lines between the polygons represent the edges along which the stack of nets can be folded. For example, dashed lines 154 are the edges of polygon 156 along which the stack of nets can be folded.

The outer-layer net 152 presents a planar surface as shown in FIG. 2 and has openings for connection of the SSL elements to the underlying inner-layer net, portions of which are visible through the openings. For example, polygon 158 has openings 160. A respective SSL element 162 is disposed in each opening. Each of the SSL elements has at least an anode and a cathode for connecting to the outer-layer net and to the inner-layer net. For example, each SSL element is wire bonded to the outer layer net 152 as represented by each instance of wire 164, and wire bonded to the inner layer net as represented by wire 166.

Though not shown, a current control device, such as a resistor, may be coupled between one of the anode or cathode and the outer-layer net or the inner-layer net. In addition and though not shown, it will be appreciated that the SSL elements may have control terminals. The control terminals may enable dimming, adjusting of color-tone, and turning-on and turning-off power to the SSL elements.

The outer-layer net and the inner-layer net are cut from electrically conductive sheets, which may be aluminum or copper, depending on implementation requirements. The thickness of the electrically conductive sheets may vary, such as from foil to thicker sheet metal. The evenness of current distribution and ability to dissipate heat by the electrically conductive outer-layer net and the inner-layer net vary according to the surface area and thickness of the sheets. In addition, employing electrically conductive sheets to provide power to the SSL elements avoids the use of hazardous chemicals as would be used in printing and etching conductors on a flexible substrate.

As an optional feature in some implementations, each of the outer-layer net and the inner-layer net has a respective tab 170 and 172, which may be used for connecting to a power source. Tab 170 is connected to the outer-layer net, and tab 172 is connected to the inner-layer net. In other implementations, the outer-layer net and the inner-layer net can be coupled to an Edison base (not shown).

In some implementations, the outer-layer net, the dielectric layer, and/or the inner-layer net may include extra material for attaching non-adjacent parts of the net to one another or to a support frame with a pressure sensitive adhesive, for example. For example, portions 174 and 176 extend from polygon 178, portions 180 and 182 extend from polygon 184, and portions 186 and 188 extend from polygon 190.

FIG. 3 shows a top view of a dielectric net 200 of the stack of nets shown in FIG. 2 for the lighting apparatus of FIG. 1. In an example implementation, the dielectric net is polyester.

The dielectric net 200 has openings that expose the underlying inner-layer net (not shown) for connection to the SSL elements. The positions of the openings in the dielectric net are aligned with the openings in the outer-layer net shown in FIG. 2. For example, the openings 202 in polygon 204 are aligned with openings 160 in polygon 158 of FIG. 2. In some implementations, the dielectric net can include extra material for attaching non-adjacent parts of the net to one another or to a support frame as described above. The optional extra material is shown as portions 206.

FIG. 4 shows a top view of the inner-layer net of the stack of nets shown in FIG. 2 for the lighting apparatus of FIG. 1. The inner-layer net 250 presents a planar surface as shown in FIG. 4 and is an electrically conductive sheet of copper or aluminum, for example. In one implementation, the inner-layer net includes tab 172 for connecting to a power source. The inner-layer net may also include extra material for attaching non-adjacent parts of the net to one another as described above. The optional extra material is shown as portions 252.

Figure 5:
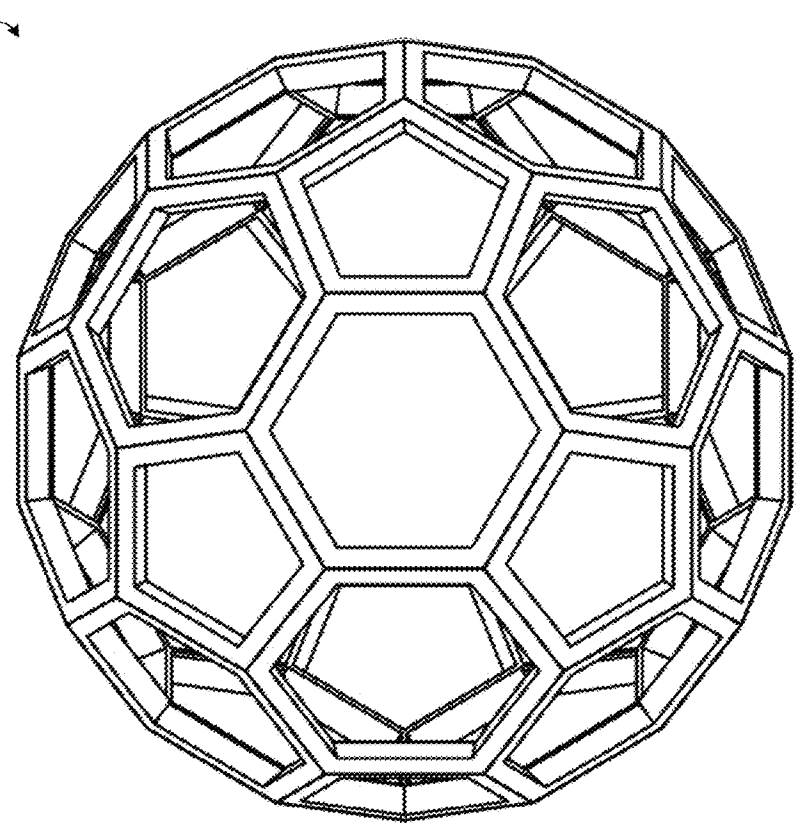
FIG. 5 shows an inner frame for the lighting apparatus of FIG. 1.

FIG. 5 shows an inner frame 300 for the lighting apparatus of FIG. 1. In one implementation, the stack of nets shown in FIG. 2 is folded to conform to the shape of the inner frame. The stack of nets may be attached to the inner frame by an adhesive, for example. For some implementations, the inner frame may be unnecessary as the stack of nets folded and/or bent into the desired shape may be sufficiently rigid to obviate the support that an inner frame would provide. In addition to supporting the stack of nets, the inner frame may provide structure for attaching additional circuitry, such as micro-controllers and an AC-DC converter.

A type of plastic or other material suitable for a desired application can be used to implement the inner frame. The inner frame may be constructed by injection molding or 3D printing. For complex frame structures, such as the truncated icosahedron of FIG. 5, the complete frame may be made by first separately constructing two halves and then joining the halves together to form the complete frame.

Figure 6:
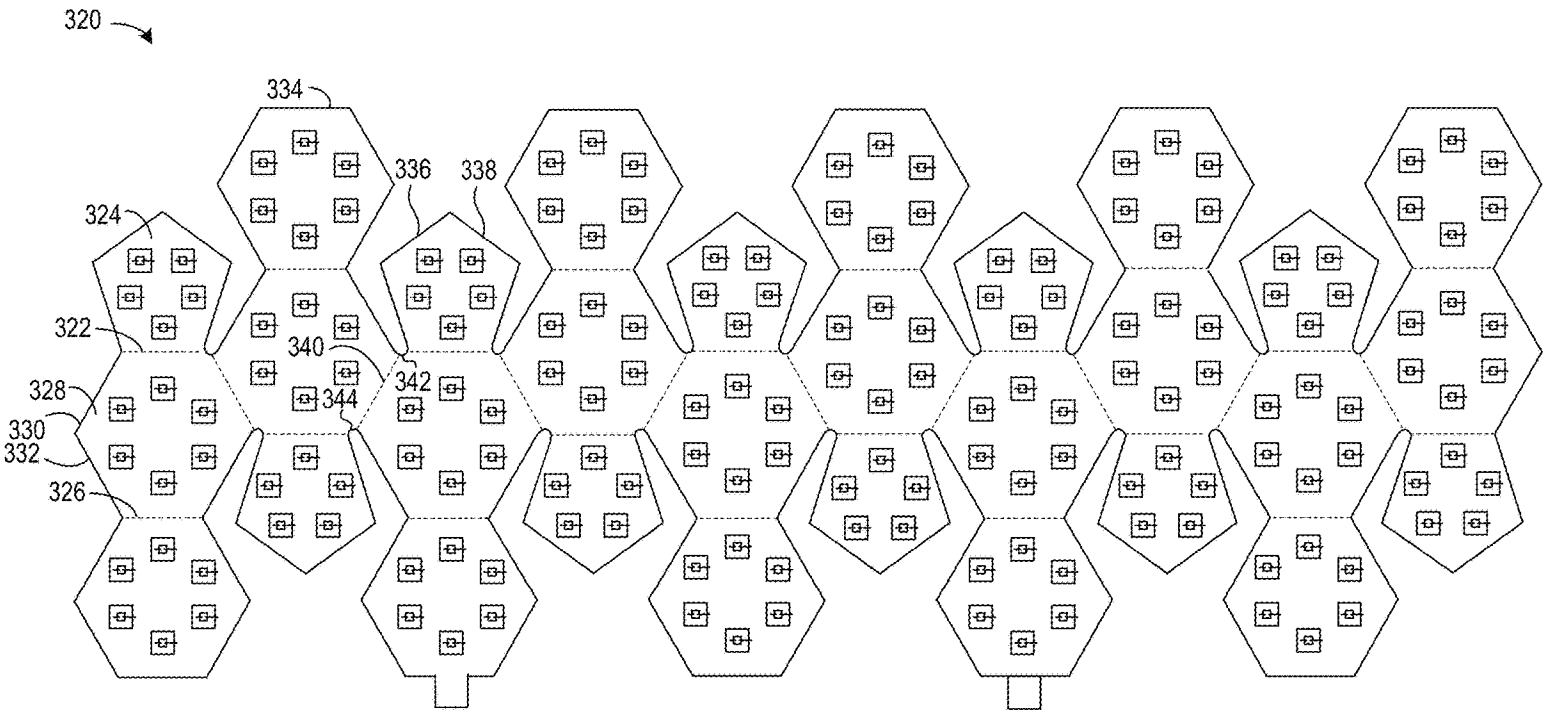
FIG. 6 shows a top view of a stack of nets for a lighting apparatus according to another implementation.

FIG. 6 shows a top view of a stack of nets 320 for a lighting apparatus according to another implementation. The stack of nets 320 differs from the stack of nets 150 of FIG. 2 in that the polygons are reshaped from those shown in FIG. 2, with the sides of each polygon not being of equal length and a curved cut-out at each end of some of the fold lines. For example, side 322 of polygon 324 is shorter than the other sides of polygon 324, and sides 322 and 326 of polygon 328 are shorter than the sides 330 and 332. Also, at each end of fold line 340, curved cut-outs 342 and 344 change the shape of the stack of nets 320 relative to the to the stack of nets shown in FIG. 2.

The changes in the shapes of the polygons serves a number of purposes. In one regard, the shape reduces the risk of damaging the stack of nets and creating a short circuit between the outer-layer net and the inner-layer net when the stack of nets is bent in to the desired shape. The change in shapes also allows edges of some of the polygons to be inserted into grooves formed in the inner support frame. Thus, in addition to or in lieu of an adhesive, the edges placed into the grooves of the inner frame secure the stack of nets to the frame. For example, edges 334, 336, 338 and others may engage grooves (not shown) in the frame 300 of FIG. 5.

The curved cut-outs at each end of some of the fold lines eliminates ridges of material that may arise in folding the stack of nets. For example, the curved cut-outs 342 and 344 at the ends of fold line 340 eliminate ridges that may be formed when the stack of nets 150 in FIG. 2 is folded at the ends of the corresponding fold line.

The dielectric net and the inner-layer net in the stack of nets 320 are largely obscured by the outer layer net. The dielectric net and inner-layer net conform to the shape of the outer layer net visible in FIG. 6.

Figure 7:
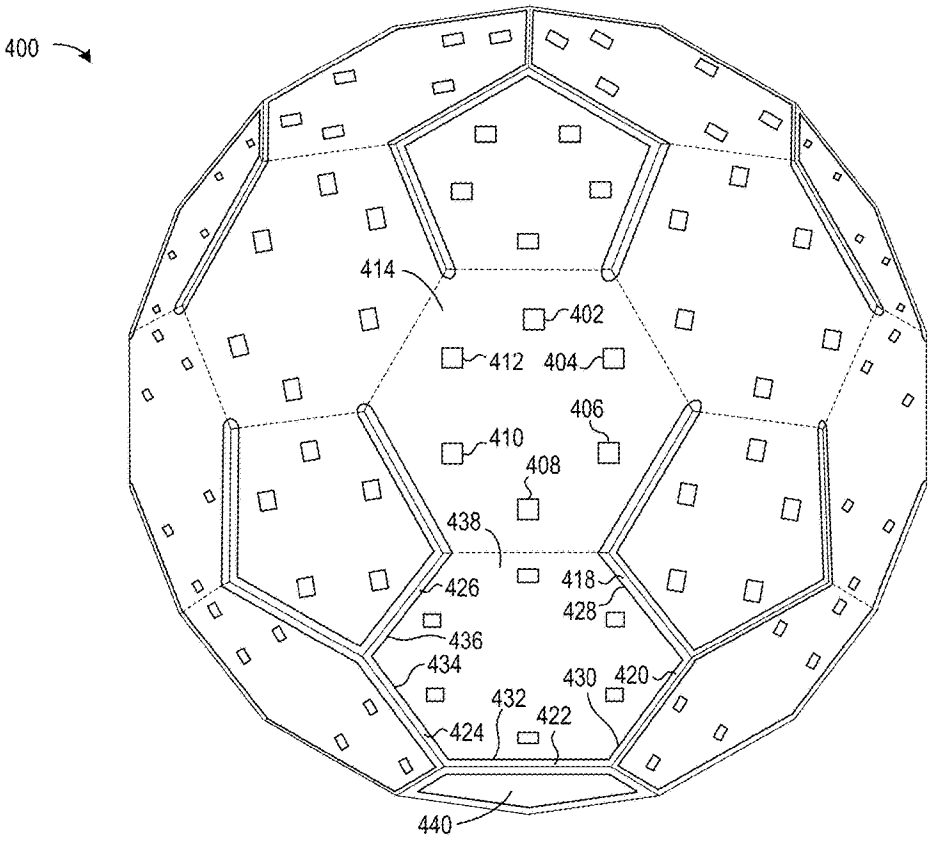
FIG. 7 shows a lighting apparatus that includes the stack of nets of FIG. 6 mounted on the inner frame of FIG. 5.

The stack of nets 320 can be folded along edges between the polygons to form the lighting apparatus shown in FIG. 7. FIG. 7 shows a lighting apparatus 400 that includes the stack of nets of FIG. 6 mounted on the inner frame of FIG. 5. Blocks 402, 404, 406, 408, 410, and 412 represent the SSL elements on face 414. Similar blocks on other faces also represent SSL elements. The SSL elements may be attached to the net in any pattern that satisfies application requirements. Different faces may have the SSL elements at different locations, and/or different faces may have different numbers of SSL elements. Dashed lines represent and correspond to the fold lines in the stack of nets 320 of FIG. 6.

In the example implementation, portions of the frame are not covered by the stack of nets. For example, portions 418, 420, 422, 424, and 426 of the frame are not covered by the stack of nets. Edges 428, 430, 432, 434, and 436 of polygon 438 are attached to the exposed portions 418, 420, 422, 424, and 426, respectively. The edges can be attached to the frame by an adhesive or by inserting the edges into grooves formed in the exposed members of the frame.

In the exemplary lighting apparatus, the polyhedron has two faces that are not covered by the stack of nets. Face 440 is one of the uncovered faces and is visible in the perspective view of FIG. 7. The other uncovered face is not visible in FIG. 7.

The lighting apparatus 400 may also include a globe (not shown) that surrounds the stack of nets and SSL elements. The globe may include phosphorous or organic ink to convert the light from the SSL elements to a desired color.

Figure 8:
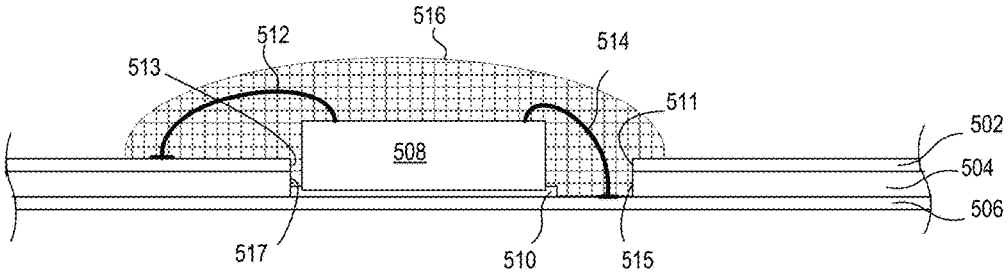
FIG. 8 is a side, cross-sectional view of an SSL element connected to the outer-layer net and to the inner-layer net of a stack of nets.

FIG. 8 is a side, cross-sectional view of an SSL element connected to the outer-layer net and to the inner-layer net of a stack of nets, such as the stacks of nets 150 and 320 shown in FIGS. 2 and 6. The stack of nets includes outer-layer net 502, dielectric net 504, and inner-layer net 506. SSL element 508 is disposed in the aligned openings of the outer-layer net and dielectric net and attached to the inner-layer net with an adhesive 510. The opening in the outer-layer net is bounded by edges 511 and 513, and the opening in the dielectric net is bounded by edges 515 and 517. The SSL element is electrically connected to the outer-layer net and to the inner-layer net by bond wires 512 and 514, respectively.

The SSL element is encapsulated in jettable material 516, such as a silicone. In one implementation, the jettable material may be phosphor-filled or include an organic dye to shift the light (e.g., blue light) emitted from the SSL element 508 to a desired color (e.g., white). The encapsulation of the SSL element produces the desired color shift as well as seals and protects the bond wires 512 and 514 and the connections from impacts and corrosive contaminants.

Figure 9:
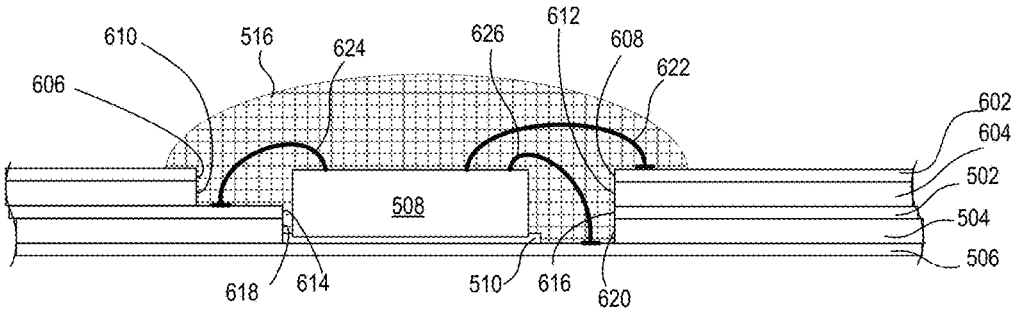
FIG. 9 is a side, cross-sectional view of an SSL element connected to three electrically conductive nets of a stack of nets.

FIG. 9 is a side, cross-sectional view of an SSL element connected to three electrically conductive nets of a stack of nets, such as the stacks of nets 150 and 320 shown in FIGS. 2 and 6. The stack of nets includes outer-layer net 602, a first dielectric net 604, a first inner-layer net 502, a second dielectric net 504, and a second inner-layer net 506. Nets 602, 502 and 506 provide power and control to the SSL element 508, and any one of the nets 602, 502 and 506 may be for control. The control net provides a control signal to the SSL element, which may be for dimming, adjusting of color-tone, and turning-on and turning-off power to the SSL element.

SSL element 508 is disposed in the aligned openings of the outer-layer net 602 and the dielectric net 604, and the aligned openings in inner-layer net 502 and dielectric net 504. The SSL element is attached to the inner layer net 506 with an adhesive 510. The opening in the outer-layer net 602 is bounded by edges 606 and 608, and the opening in the dielectric net 604 is bounded by edges 610 and 612. The opening in the inner-layer net 502 is bounded by edges 614 and 616, and the opening in the dielectric net 504 is bounded by edges 618 and 620. The SSL element is electrically connected to the outer-layer net 602, to the inner-layer net 502, and inner-layer net 506 by bond wires 622, 624, and 626, respectively. The SSL element is encapsulated in jettable material 516.

Figure 10:
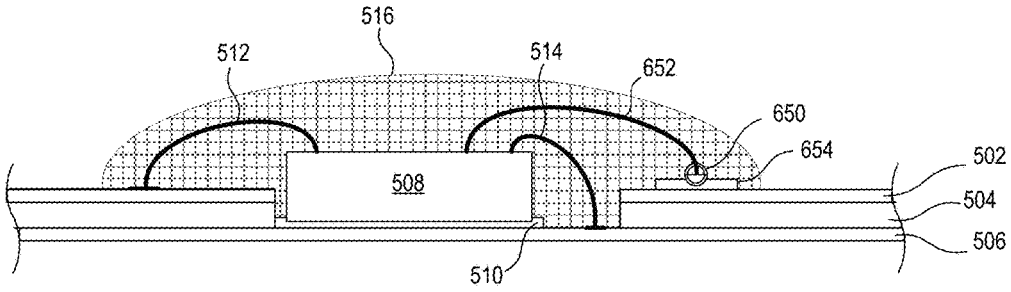
FIG. 10 is a side, cross-sectional view of an SSL element connected to a control wire and to the outer-layer net and the inner-layer net of a stack of nets.

FIG. 10 is a side, cross-sectional view of an SSL element connected to a control wire 650 and to the outer-layer net and the inner-layer net of a stack of nets, such as the stacks of nets 150 and 320 shown in FIGS. 2 and 6. The control wire 650 may be used to provide a control signal to the SSL element for dimming, adjusting of color-tone, and turning-on and turning-off power.

The SSL element is electrically connected to the outer-layer net 502, the inner-layer net 506, and to the control wire 650 by bond wires 512, 514, and 652, respectively. The SSL element is encapsulated in jettable material 516.

In one implementation, the control wire 650 is an insulated wire and is disposed on a surface of the outer-layer net 502. The wire may be attached to the electrically conductive sheet using a pressure sensitive adhesive 654, for example. The wire may be a fine gauge, round (round cross-section), bare wire. For example, 44 gauge (AWG) copper wire has been found to be suitable for some applications. However, different gauges may be suitable for different applications. "Wire" as used herein does not refer to printed or printed-and-etched patterns of conductive material. Rather, as used herein wire refers to one or more strands of conductive material that have been made by drawing the conductive material through draw plates, for example.

The connecting portions of the wire 650 have planar landing areas to which bond wires from the SSL elements may be connected. The planar landing areas extend longitudinally (lengthwise) along the wire. The connecting portions of the wire may be milled to form the planar landing areas on the wire. Alternatively, connecting portions of the wire may be stamped to form the planar landing areas and the insulation may be stripped from the portions of the wire to which the bond wires are to connect, leaving insulation between the wire and the outer-layer net 502. In an example implementation, the control wire is copper, and the bond wire is either gold or aluminum. Aspects of wire bonding to a round wire are also described in the co-pending U.S. patent application Ser. No. 14/553,519, entitled, "Wire Bonded IC Components to Round Wire," filed on Nov. 25, 2014 by Scott Lindblad et al., and is assigned to the same assignee as the present application, and the entire contents of the co-pending patent application Ser. No. 14/553,519 are incorporated herein by reference. The entire contents of co-pending patent application Ser. No. 14/928,289, entitled, "Wire Bonded Electronic Devices to Round Wire," filed on Oct. 30, 2015, by Robert Neuman, and is assigned to the same assignee as the present application, are incorporated herein by reference.

Figure 11:
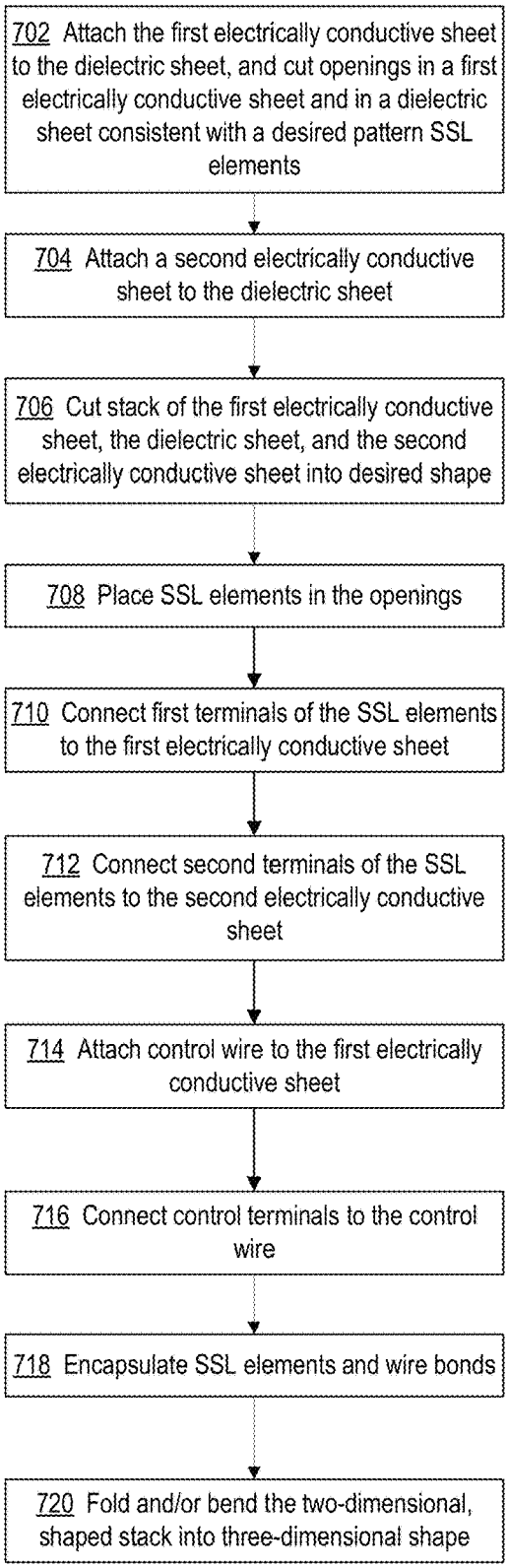
FIG. 11 is a flowchart of a process for constructing a lighting apparatus.

FIG. 11 is a flowchart of a process for constructing a lighting apparatus. At block 702, a first electrically conductive sheet is attached to a dielectric sheet, and aligned openings are cut in the first electrically conductive sheet and in the dielectric sheet. The pattern of the openings is consistent with a desired pattern, such as on a net of a polyhedron as shown in FIGS. 2 and 6. The first electrically conductive sheet can be attached to a dielectric sheet by a pressure-sensitive adhesive, for example. The openings can be formed by a machine press or other apparatus.

At block 704, a second electrically conductive sheet is attached to the dielectric sheet, such as by a pressure-sensitive adhesive. The first electrically conductive sheet and the second electrically conductive sheet attached to the dielectric sheet form a stack, which has a first major surface and an opposing second major surface that are planar. The generally planar stack provides a convenient workpiece for attaching the SSL elements.

The stack that includes the first electrically conductive sheet, the dielectric sheet, and second electrically conductive sheet is cut into a desired shape at block 706. The shape of the stack in two dimensions is a shape that when bent forms the desired three-dimensional shape of a lighting apparatus. For example, the stack may be cut into the shape of net of a polyhedron or a shape that approximates the net of a polyhedron.

At block 708, SSL elements are placed in the openings of the first electrically conductive sheet and the dielectric sheet and are attached to the second electrically conductive sheet such as with a pressure-sensitive adhesive. One of the power terminals of each SSL element is connected to the first electrically conductive sheet at block 710, and the other power terminal is connected to the second conductive sheet at block 712. In an example implementation, the SSL elements are wire bonded to the electrically conductive sheets.

At block 714, one or more control wires are attached to the first electrically conductive sheet, and the control terminals of the SSL elements are connected to the control wire(s) at block 716, such as by wire bonding.

At block 718, the SSL elements are individually encapsulated along with the associated bond wires. The SSL elements can be encapsulated by jetting a silicone based material, which may include phosphorous or an organic dye, into the openings and covering the respective SSL elements and bond wires.

At block 720, the stack having the first electrically conductive sheet, the dielectric sheet, the second electrically conductive sheet, SSL elements, and control wire(s) is bent into a desired three-dimensional shape. The bending of the stack changes the shape of the stack such that the first major surface and second major surface change from planar to three-dimensional. The process of bending the stack can include attaching the stack to a frame, which provides support for the bent stack and structure for attaching additional circuitry.

The order of the procedures described in the process of FIG. 11 is exemplary, as those skilled in the art will recognize that in practice the procedures may be performed in an alternative order. For example, the order of attaching the sheets, cutting of the openings, and cutting of the stack into the desired shape may be varied. Also, the control wire may be attached before the SSL elements are placed.

Though aspects and features may in some cases be described in individual figures, it will be appreciated that features from one figure can be combined with features of another figure even though the combination is not explicitly shown or explicitly described as a combination.

The present invention is thought to be applicable to a variety of lighting applications. Other aspects and embodiments will be apparent to those skilled in the art from consideration of the specification and practice disclosed herein. It is intended that the disclosed apparatus and method be considered as examples only, with a true scope of the invention being indicated by the following claims.

What is claimed is:

1. A lighting apparatus, comprising:

a first electrically conductive net of a polyhedron;

a first dielectric net of the polyhedron, the first dielectric net disposed on the first electrically conductive net;

a second electrically conductive net of the polyhedron, the second electrically conductive net disposed on the first dielectric net; and a plurality of solid-state lighting (SSL) elements electrically coupled to the first electrically conductive net and to the second electrically conductive net; and wherein the first electrically conductive net, first dielectric net, and second electrically conductive net have bends that configure the first electrically conductive net, first dielectric net, and second electrically conductive net in a shape of the polyhedron.

2. The lighting apparatus of claim 1, further comprising a polyhedral frame, wherein the first electrically conductive net, first dielectric net, and second electrically conductive net at least partially cover the polyhedral frame.

3. The lighting apparatus of claim 1, wherein the first electrically conductive net is one of a sheet of aluminum sheet or a sheet of copper.

4. The lighting apparatus of claim 3, wherein the second electrically conductive net is one of an aluminum net or a copper net.

5. The lighting apparatus of claim 1, wherein:

the first electrically conductive net has a first plurality of openings that are aligned with a second plurality of openings in the first dielectric net; and the plurality of SSL elements are disposed in first plurality of openings, respectively.

6. The lighting apparatus of claim 5, wherein the plurality of SSL elements are wire bonded to the first electrically conductive net and to the second electrically conductive net.

7. The lighting apparatus of claim 5, wherein the first plurality of openings and the second plurality of openings are aligned with a third plurality of openings in the second electrically conductive net, and the lighting apparatus further comprises:

a second dielectric net of the polyhedron having a fourth plurality of openings aligned with the third plurality of openings of the second electrically conductive net and disposed on the second electrically conductive net;

a third electrically conductive net of the polyhedron having a fifth plurality of openings aligned with the fourth plurality of openings of the second dielectric net and disposed on the second dielectric net; and wherein the plurality of SSL elements have control terminals coupled to the third electrically conductive net.

8. The lighting apparatus of claim 7, wherein:

the plurality of SSL elements are wire bonded to the to the first electrically conductive net, to the second electrically conductive net, and to the third electrically conductive net.

9. The lighting apparatus of claim 5, further comprising:

an insulated control wire disposed on the second electrically conductive net; and wherein the plurality of SSL elements have control terminals coupled to the control wire.

10. The lighting apparatus of claim 9, wherein:

the plurality of SSL elements are wire bonded to the to the first electrically conductive net, to the second electrically conductive net, and to the control wire.

11. The lighting apparatus of claim 1, wherein:

the first electrically conductive net has a first plurality of openings that are aligned with a second plurality of openings in the first dielectric net; and the plurality of SSL elements are disposed in first plurality of openings, respectively;

the plurality of SSL elements are wire bonded with bond wires to the first electrically conductive net and to the second electrically conductive net; and the first plurality of openings and the second plurality of openings are filled with an encapsulant that individually covers each of plurality of SSL elements and connected bond wires.

12. A lighting apparatus, comprising:

a first electrically conductive sheet;

a first dielectric sheet, the first dielectric sheet disposed on the first electrically conductive sheet;

a second electrically conductive sheet, the second electrically conductive sheet disposed on the first dielectric sheet; and a plurality of solid-state lighting (SSL) elements electrically coupled to the first electrically conductive sheet and to the second electrically conductive sheet; and wherein the first electrically conductive sheet, first dielectric sheet, and second electrically conductive sheet have bends in respective surfaces thereof that configure the first electrically conductive sheet, first dielectric sheet, and second electrically conductive sheet in a three-dimensional shape having planar surface regions thereof that extend between edges of the surfaces and intersect at the bends.

13. The lighting apparatus of claim 12, wherein:

the first electrically conductive sheet has a first plurality of openings that are aligned with a second plurality of openings in the first dielectric sheet; and the plurality of SSL elements are disposed in first plurality of openings, respectively.

14. A method of making a lighting apparatus, comprising:

forming a first plurality of openings in a first electrically conductive sheet and a second plurality of openings in a dielectric sheet;

attaching the first electrically conductive sheet to the dielectric sheet, wherein the first plurality of openings are aligned with the second plurality of openings;

attaching a second electrically conductive sheet to the dielectric sheet to form a stack, wherein the stack has a first major surface and an opposing second major surface, and the first major surface and the second major surface are planar;

connecting a plurality of solid-state lighting (SSL) elements to the first electrically conductive sheet and to the second electrically conductive sheet through the first and second pluralities of openings, respectively; and bending the first electrically conductive sheet, the dielectric sheet, and the second electrically conductive sheet such that the first major surface and second major surface acquire a three-dimensional shape.

15. The method of claim 14, further comprising cutting the stack into a net of a polyhedron.

16. The method of claim 15, wherein the bending includes attaching net to a polyhedral frame.

17. The method of claim 14, wherein the bending includes attaching stack to a frame.

18. The method of claim 14, wherein the connecting includes wire bonding the SSL elements to the first electrically conductive sheet and to the second electrically conductive sheet.

19. The method of claim 14, further comprising:

attaching a control wire to the first electrically conductive sheet; and connecting control terminals of the plurality of SSL elements to the control wire.

20. The method of claim 14, further comprising:

wherein the connecting includes wire bonding the SSL elements to the first electrically conductive sheet and to the second electrically conductive sheet; and individually encapsulating each SSL element of the plurality of SSL elements and associated bond wires.

* * * * *